US005169339A

United States Patent [19]

Nakata et al.

[11] Patent Number: 5,169,339

[45] Date of Patent: Dec. 8, 1992

[54] ELECTRICAL CONNECTOR

[75] Inventors: Naohisa Nakata; Kensaku Sato, both of Tokyo, Japan

[73] Assignee: Hirose Electric Co., Ltd., Tokyo, Japan

[21] Appl. No.: 796,646

[22] Filed: Nov. 22, 1991

[30] Foreign Application Priority Data

Dec. 6, 1990 [JP] Japan ..... 2-401475[U]

[51] Int. Cl.[5] ..... H01R 13/648

[52] U.S. Cl. ..... 439/607; 439/609

[58] Field of Search ..... 439/95, 108, 607-610

[56] References Cited

U.S. PATENT DOCUMENTS 5,035,652 7/1991 Shibano ..... 439/610

5,041,022 8/1991 Sekiguchi ..... 439/609

*Primary Examiner*—Gary F. Paumen

*Attorney, Agent, or Firm*—Kanesaka & Takeuchi

[57] ABSTRACT

An electrical connector includes a connector housing (3) having a mounting portion (8) to be mounted on a metallic panel (50), and outer and inner tubular portions (6, 7) extending forwardly from the mounting portion to form a connector fitting recess (12) between them; a lock recess (13) formed on the outer tubular portion for engagement with a lock arm (45) of a mating connector (2); a contact terminal assembly (4) inserted into the inner tubular portion and having a shield jacket (24) around the contact terminal assembly, the contact terminal assembly comprising an insulation body (27) pressed-fit in the shield jacket and an electrical contact element (26) supported by the insulation body.

1 Claim, 12 Drawing Sheets

ELECTRICAL CONNECTOR

BACKGROUND OF THE INVENTION

1. Field of the Invention

The present invention relates to light straight DIP connectors for shielded cables which are used for electronic equipment or the like.

2. Description of the Prior Art

In FIG. 31, a conventional electrical connector of this type or connector socket (a) of the electrical connector includes a metallic jacket (b) in which contacts are mounted via an insulating body. This connector socket is attached to a panel (c) by fastening the flange (d) to the panel with screws (e). To lock a connector plug to this connector socket, the connector plug is threaded over the connector socket.

In the above connector, however, it is impossible to connect and disconnect the connector plug from the connector socket with a single touch because it is necessary to thread the connector plug over the connector socket.

SUMMARY OF THE INVENTION

Accordingly, it is an object of the invention to provide an electrical connector socket which is easy to connect and disconnect a connector plug with a single touch.

It is another object of the invention to provide an electrical connector socket which is durable against forcible plugging in and out of the connector socket of a connector plug.

It is still another object of the invention to provide an electrical socket which is connected firmly to a connector plug and is resistant against vibrations, thus suitable for use in automobile electronic equipment.

According to the invention there is provided a connector socket which includes a socket housing having a mounting portion to be mounted on a printed circuit board or the like, and inner and outer tubular portions extending forwardly from the mounting portion to form a plug fitting recess between them; a lock recess formed on the outer tubular portion for engagement with a lock arm of a connector plug; a contact terminal assembly inserted into the inner tubular portion and having a shield jacket, said contact terminal assembly comprising an insulation body and an electrical contact element supported by the insulation body.

With the connector socket according to the invention it is possible to connect and disconnect a connector plug from the connector socket with a single touch because the fitting portion of the connector plug is fitted into the fitting recess of the connector socket to bring the contact terminal of the connector plug into contact with the contact portion of the connector socket while the lock arm of the connector plug is engaged with the lock recess of the connector socket for locking. The strength against the forcible plugging in and out of the connector socket of the connector plug is increased because the contact terminal is placed within the socket housing which is secured to a printed circuit board when the contact terminal is mounted on the PCB. Since the lock recess which engages the lock arm of the connector plug is formed on the socket housing, the connection between the connector plug and socket is very strong and resistant against vibrations and suitable for automotive electronic equipment.

The above and other objects, features, and advantages of the invention will be more apparent from the following description when taken in conjunction with the accompanying drawings.

DESCRIPTION OF THE PREFERRED EMBODIMENT

Figure 1:
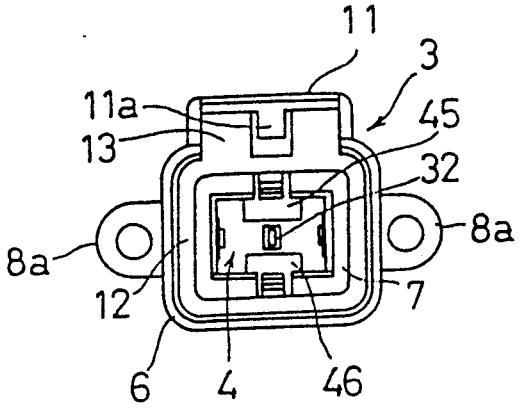
FIG. 1 is a front view of a connector socket according to an embodiment of the invention.
Figure 30:
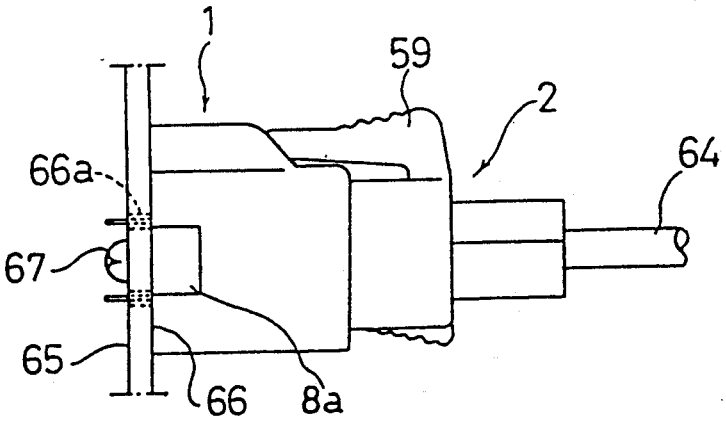
FIG. 30 is a side view showing the connection of the connector plug into the connector socket.
Figure 2:
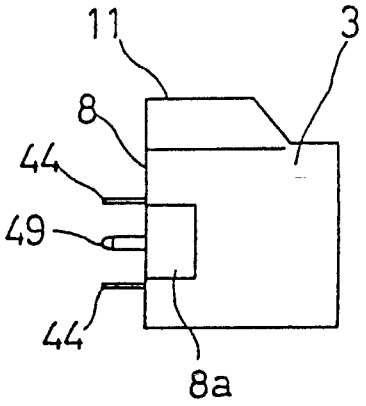
FIG. 2 is a side view of the connector socket.
Figure 3:
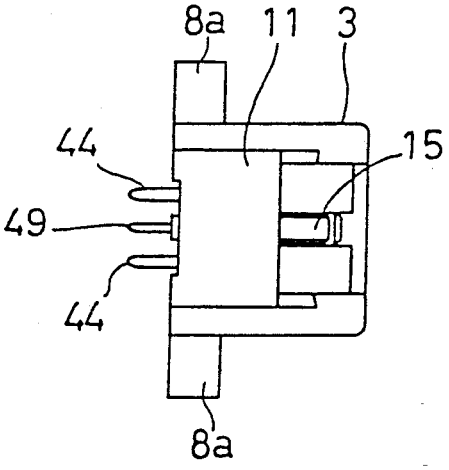
FIG. 3 is a top plan view of the connector socket.
Figure 4:
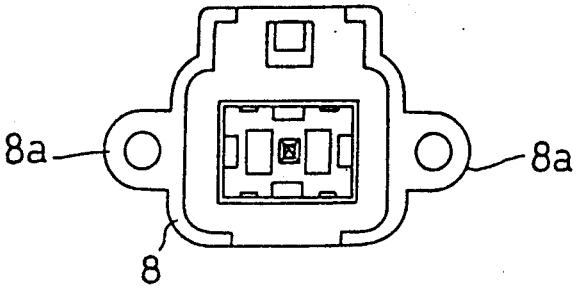
FIG. 4 is a rear view of the connector socket.
Figure 5:
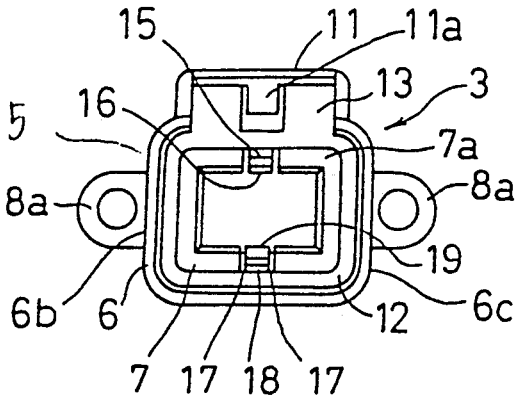
FIG. 5 is a front view of a socket housing useful for the connector socket.
Figure 6:
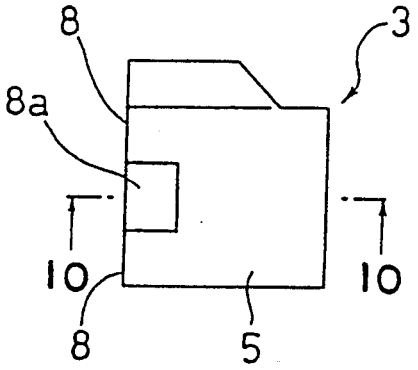
FIG. 6 is a side view of the socket housing.
Figure 7:
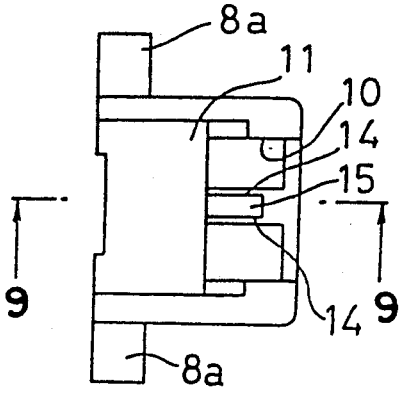
FIG. 7 is a top plan view of the socket housing.
Figure 8:
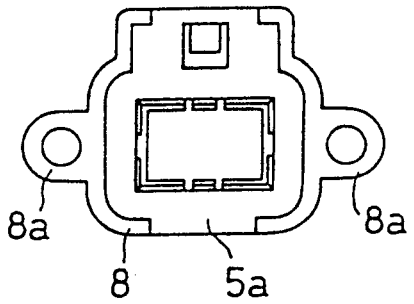
FIG. 8 is a rear view of the socket housing.
Figure 9:
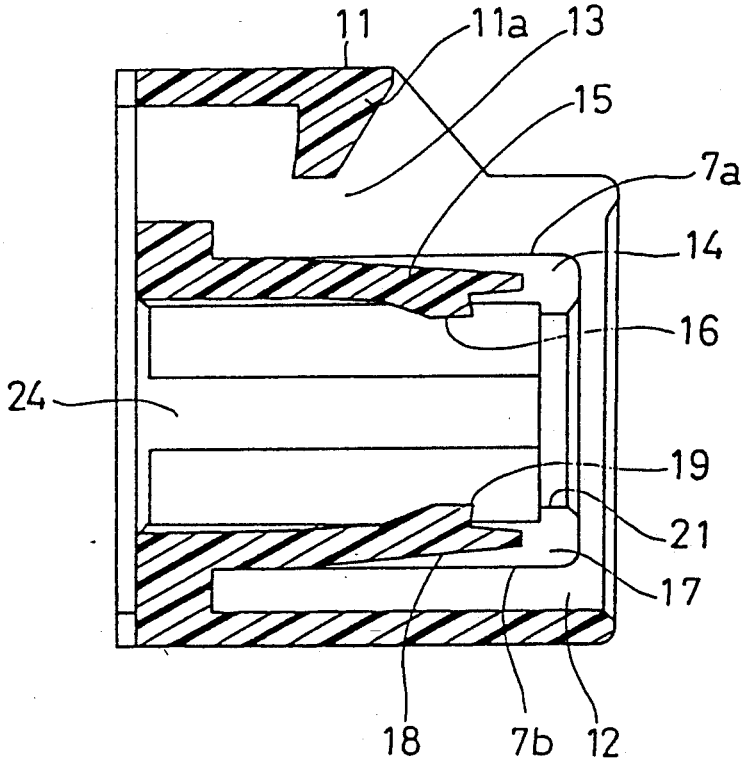
FIG. 9 is a sectional view taken along line 9—9 of FIG. 7.
Figure 10:
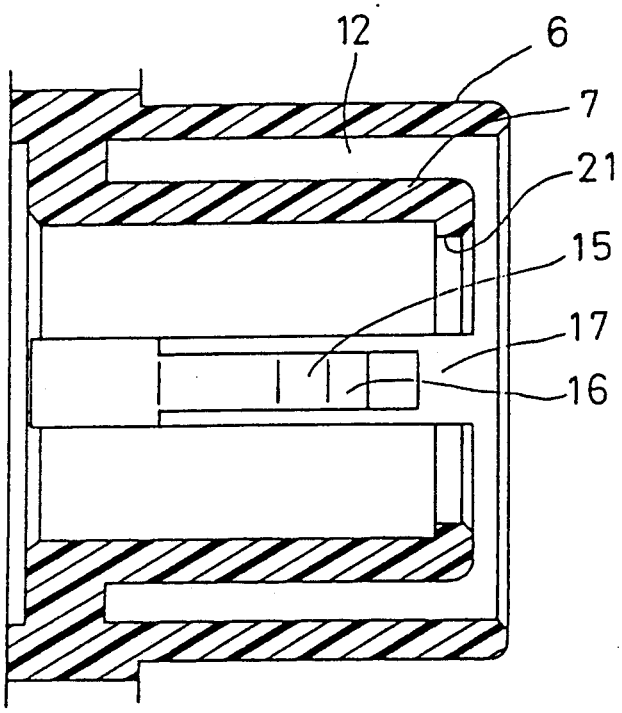
FIG. 10 is a sectional view taken along line 10—10 of FIG. 6.
Figure 11:
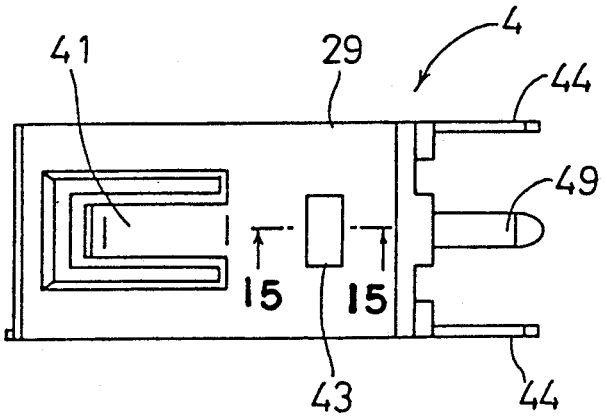
FIG. 11 is a side view of a contact terminal useful for the connector socket.
Figure 12:
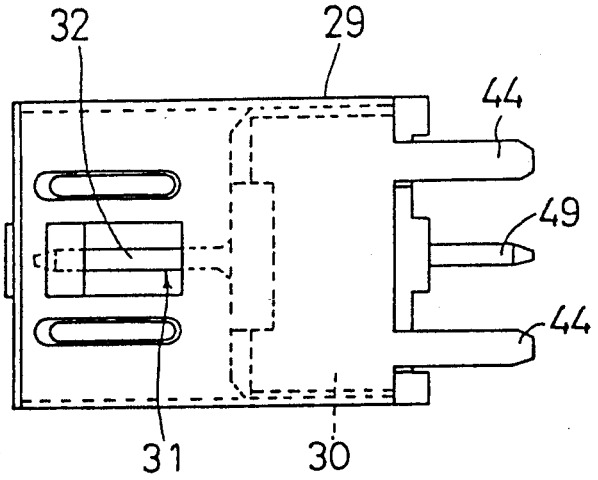
FIG. 12 is a top plan view of the contact terminal.
Figure 13:
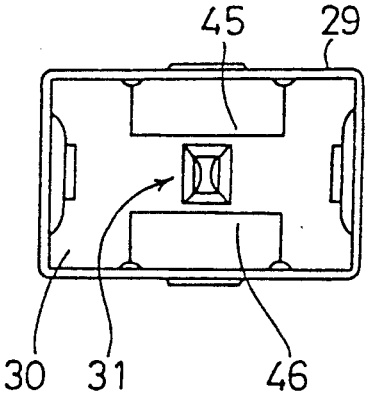
FIG. 13 is a front view of the contact terminal.
Figure 14:
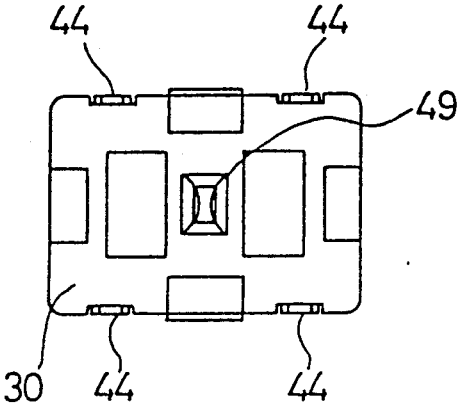
FIG. 14 is a rear view of the contact terminal; is a front view of a ground plate useful for the connector socket.
Figure 15:
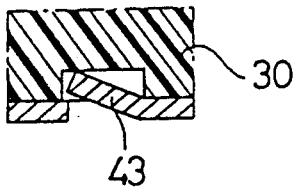
FIG. 15 is a sectional view taken along line 15—15 of FIG. 11.
Figure 16:
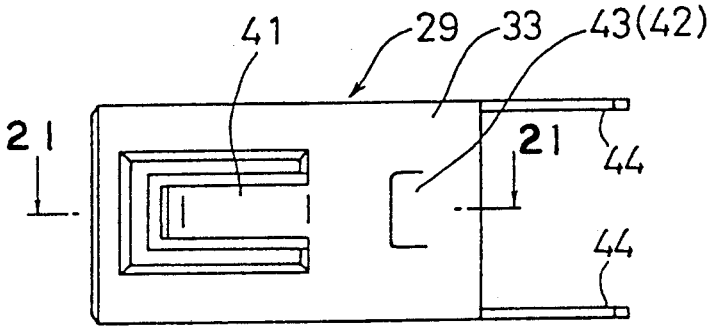
FIG. 16 is a side view of a shield jacket useful for the connector socket.
Figure 17:
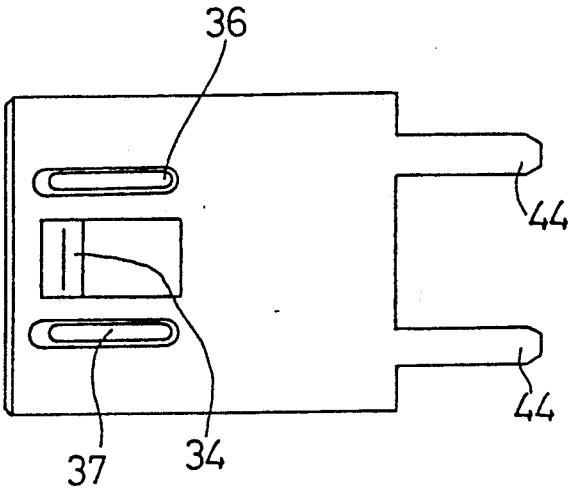
FIG. 17 is a top plan view of the shield jacket.
Figure 18:
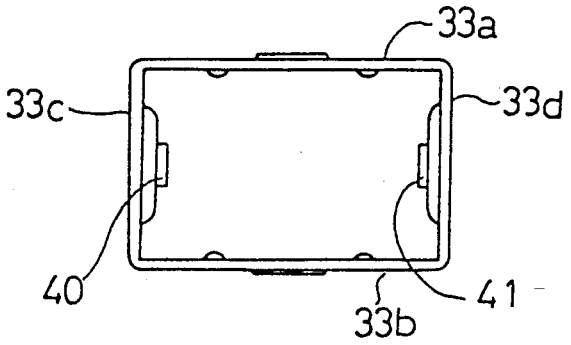
FIG. 18 is a front view of the shield jacket.
Figure 19:
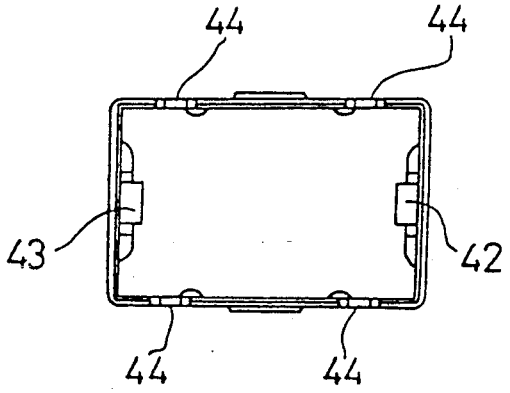
FIG. 19 is a rear view of the shield jacket.
Figure 20:
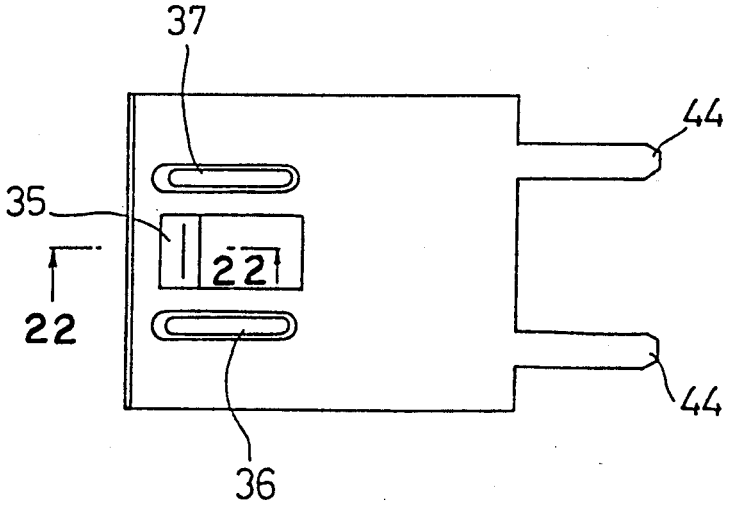
FIG. 20 is a bottom view of the shield jacket.
Figure 21:
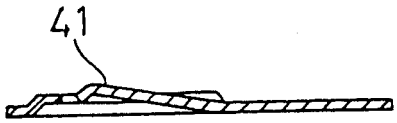
FIG. 21 is a sectional view taken along line 21—21 of FIG. 16.
Figure 22:
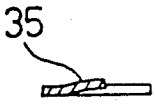
FIG. 22 is a sectional view taken along line 22—22 of FIG. 20.
Figure 23:
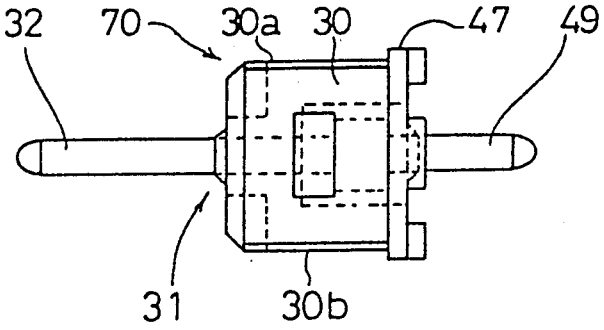
FIG. 23 is a side view of an insulation assembly useful for the connector socket.
Figure 24:
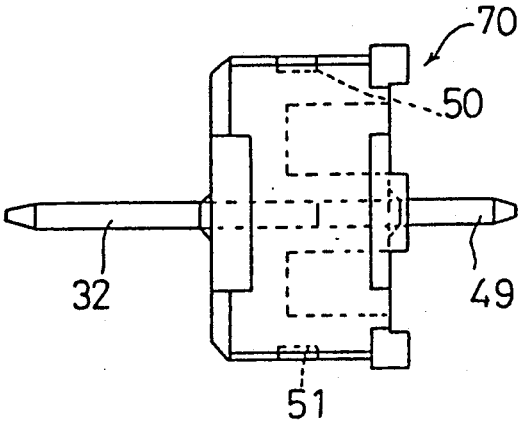
FIG. 24 is a top view of the insulation assembly.
Figure 25:
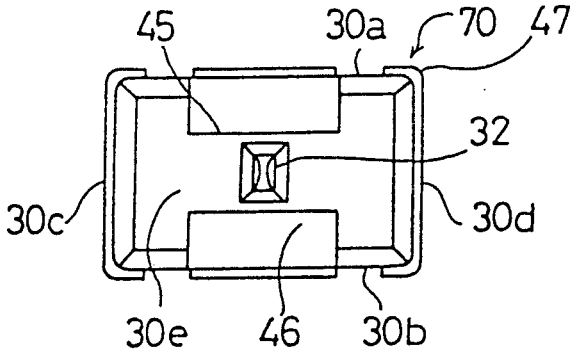
FIG. 25 is a front view of the insulation assembly.
Figure 26:
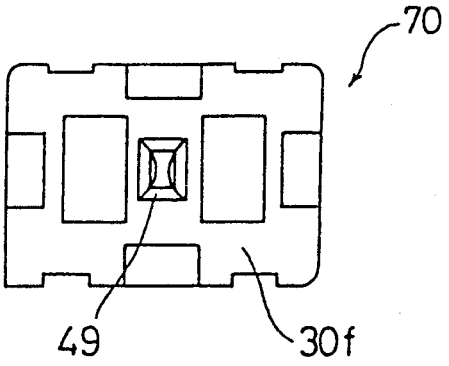
FIG. 26 is a rear view of the insulation assembly.

In FIG. 30, a straight DIP connector for a shielded cable 64 consists of a connector socket 1 and a connector plug 2.

In FIGS. 1–4, the connector socket 1 includes a socket housing 3 and an electrical contact terminal assembly 4 fitted in the socket housing 3.

In FIGS. 5–10, the socket housing 3 has a socket body 5 which is molded from a synthetic resin so as to have a rectangular outer tubular portion 6 and a rectangular inner tubular portion 7 both extending forwardly from a rear mounting face 8. A pair of mounting legs **8*a* extend laterally from the mounting face 8 on opposite sides 6*a* and 6*b* of the outer tubular portion 6**. A cutout 10 extend rearwardly from the upper front edge of the outer tubular portion 6. A cover 11 extends forwardly from the rear face 5a of the socket body 5 so as to cover the mid-to-rear portion of the cutout 10. A lock projection 11a is formed on the inside of the cover 11.

The inner tubular portion 7 is made rectangular forming a plug receiving recess 12 between the outer and inner tubular portions 6 and 7. A lock recess 13 is formed between a top face 7a of the inner tubular portion 7 and the cover portion 11. A slot 14 extends rearwardly from the front edge of the upper wall 7a of the inner tubular portion 7. A tongue member 15 extends forwardly from the rear end of the slot 14 and has an engaging projection 16 on the lower front portion. Similarly, a slot 17 extends rearwardly from the front edge of the lower wall 7b. A tongue member 18 extends forwardly from the rear end of the slot 17 and has an engaging projection 19 on the upper front portion. The inner tubular portion 7 has an opening at the rear edge and a stopper 21 raised inwardly at the front edge. A pair of press-fit channels 24 are formed on the inside faces 7c and 7d of the inner tubular portion 7.

In FIGS. 11–14, the electrical contact terminal assembly 4 includes an shield jacket 29, an insulation body 30, and an electrical contact element 31.

In FIGS. 16–22, the shield jacket 29 has a jacket body 33 stamped and formed from sheet metal. A pair of engaging tongues 34 and 35 extend rearwardly from the front portions of upper and lower faces 33a and 33b. A pair of elongated indentations 36 and 37 are formed on the upper and lower faces 33a and 33b on opposite sides of each engaging tongues 34 or 35. A pair of engaging arms 40 and 41 extend forwardly from the middle portions of side faces 33c and 33d. A pair of rectangular engaging ears 42 and 43 extend forwardly and inwardly from the rear portions of opposite sides 33c and 33d. A pair of shield terminals 44 extend rearwardly from the rear edge of each of the upper and lower faces 33a and 33b.

In FIGS. 23–26, the insulation assembly 70 consists of the insulation body 30 and the electrical contact element 31 insert molded in the insulation body 30. The insulation body 30 is of a rectangular block having four faces 30a, 30b, 30c, and 30d. A stopper portion 47 is raised along the rear edge of the insulation body 30. A pair of recesses 45 and 46 are formed on the front edges of the upper and lower faces 30a and 30b.

Figure 27:
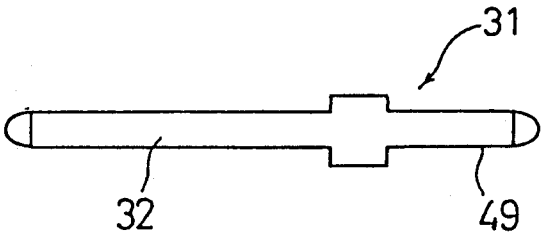
FIG. 27 is a side view of a contact terminal useful for the connector socket.

The contact element 31 has a contact portion 32 and a leg portion 49 as shown in FIG. 27. The contact element 31 is embedded in the insulation body 30 such that the contact portion 32 extends forwardly from the front face 30e of the insulation body 30 while the leg portion 49 extends rearwardly from the rear face 30f. A shielded cable 49 is connected to the contact element 31.

The insulation assembly 70 is press-fitted into the shield jacket 29 to form provide the contact terminal 4. The insulation assembly 70 is fitted into the shield jacket 29 from the back such that the engaging ears 42 and 43 engage the recesses 50 and 51 of the insulation assembly 70 while the stopper portion 47 abuts on the rear edge of the shield jacket 29. The contact portion 32 is positioned in the center of the shield jacket 29 while the leg portion 49 is positioned in the center of the shield jacket 29 in parallel to the shield terminals 44.

The contact terminal assembly 4 is inserted into the inner tubular portion 7 of the socket housing 6 from the back to form the complete connector socket 1. Thus, the front edge of the shield jacket 29 abuts on the stopper portion 21 of the inner tubular portion 7, the engaging projections 6 and 19 of the tongue members 15 and 18 engage the engaging tongues 34 and 35 of the shield jacket 29, and the contact leg 49 and the shield terminals 44 projects rearwardly in the rear opening of the socket housing 6.

Figure 28:
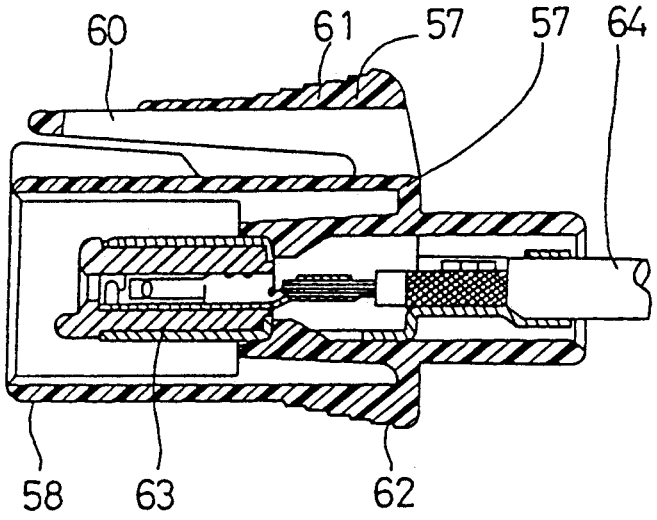
FIG. 28 is a longitudinal section of a connector plug.
Figure 29:
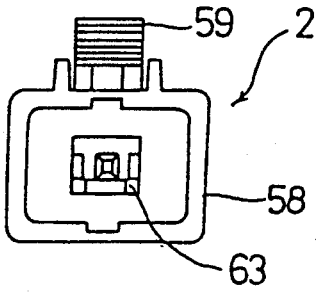
FIG. 29 is a front view of the connector plug.
Figure 31:
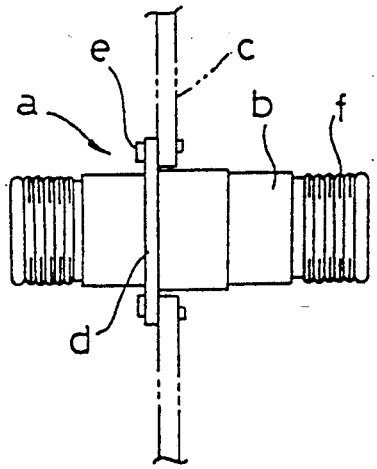
FIG. 31 PRIOR ART
FIG. 31 is a side view of a conventional electrical connector.

In FIGS. 28 and 29, the connector plug 2 includes a plug body 57 which has a rectangular front fitting portion 58. A lock arm 59 extend forwardly from the rear port the upper face of the plug body 57 and has a lock opening 60 on the front portion. The upper and lower rear faces 61 and 62 of the lock arm 59 and the plug body 57 are corrugated for preventing slippage. A contact element 63 is provided within the plug body 57 and connected to a shielded cable 64.

How to connect the connector plug 2 to the connector socket 1 will be described.

The mounting face 8 of the connector socket 1 is brought into contact with the mounting face 66 of a printed circuit board 65. The contact leg 49 and the shield terminals 44 are inserted through the throughholes 66a of the PCB 65 and soldered to the conductors. The mounting legs 8a of the socket housing 3 are secured to a printed circuit board 65 with screws 67 to mount the connector socket 1 on the PCB 65.

The fitting portion 58 of the connector plug 2 is fitted into the plug recess 12 of the connector socket 1 to bring the terminal 63 into contact with the contact position 32 while the lock arm 59 of the connector plug 2 is fitted into the lock recess 13 of the connector socket 1 such that the lock projection 11a engages the lock opening 60, thereby locking the connector plug 2 to the connector socket 1.

In the above connector, the fitting portion 44 of the connector plug 2 is fitted into the fitting recess 12 of the connector socket 1 to bring the terminal 48 into contact with the contact portion 32 of the connector socket 1 while the lock arm 59 of the connector plug 2 is fitted into the lock recess 13 of the connector socket 1 for locking, thus making possible the connection and disconnection between the connector socket 1 and the connector plug 2 with a single touch. The strength against the forcible plugging in and out of the connector socket 1 of the connector plug 2 is increased because the contact terminal assembly 4 is housed in the socket housing 3, and the socket housing 3 is secured to the printed circuit board 65 when the contact terminal 70 is mounted on the PCB 65. The lock recess 13 of the socket housing 3 into which the lock arm 59 of the connector plug 2 is fitted makes the connection of the connector plug 2 to the connector socket 1 so strong and so resistant to vibrations that the connector is suitable for use in automotive electronic equipment. At the same time, the shielding is grounded to the PCB 65.

As has been described above, the fitting portion of a connector plug is fitted into the fitting recess of a connector socket so that the terminal of the connector plug is brought into contact with the contact portion of the connector socket while the lock arm of the connector plug is fitted in the lock recess of the connector socket for making a lock, thereby making it possible to connect and disconnect the connector plug from the connector socket with a single touch. Since the contact terminal assembly is placed within the socket housing, the socket housing is secured to a printed circuit board to attach the contact terminal assembly to the printed circuit board so that the strength against forcible plugging in and out of the connector plug from the connector socket is increased. Since the lock recess into which the lock arm of the connector plug is fitted for locking is formed in the socket housing, the connection between the connector plug and socket is sufficiently strong to withstand vibrations and thus suitable for use in automobile electronic equipment.

We claim:

1. An electrical connector comprising:

a connector housing having a mounting face, and inner and outer tubular portions extending forwardly from said mounting face to form a connector fitting recess between them;

a lock recess formed on said outer tubular portion for engagement with a lock arm of a mating connector;

a contact terminal assembly inserted into said inner tubular portion and having an electrically conductive shield jacket around said contact terminal assembly, said terminal assembly comprising an insulation body press-fitted in said shield jacket and an electrical contact element supported by said insulation body.

* * * * *